United States Patent [19]

Cox

[11] Patent Number: 4,534,547

[45] Date of Patent: Aug. 13, 1985

[54] RAPID ACTING C-CLAMP

[75] Inventor: Edward A. Cox, Olympia Fields, Ill.

[73] Assignee: Wilton Corporation, Palatine, Ill.

[21] Appl. No.: 600,763

[22] Filed: Apr. 16, 1984

[51] Int. Cl.[3] ..... B25B 1/02

[52] U.S. Cl. ..... 269/182; 269/249; 269/286

[58] Field of Search ..... 74/424.8 A; 269/181, 269/182, 184–187, 249, 286, 273; 411/437

[56] References Cited

U.S. PATENT DOCUMENTS

| | | | |
|---|---|---|---|
| 2,430,458 | 11/1947 | Farrell | 269/182 |
| 3,357,698 | 12/1967 | Flynn | 269/249 |
| 3,492,886 | 2/1970 | Naureckas | 269/182 |

FOREIGN PATENT DOCUMENTS

| | | | |
|---|---|---|---|
| 233451 | 8/1959 | Australia | 269/184 |

*Primary Examiner*—Robert C. Watson

*Attorney, Agent, or Firm*—Trexler, Bushnell & Wolters, Ltd.

[57] ABSTRACT

A rapid acting C-clamp is provided. A housing in the base of the C-clamp has a generally semi-cylindrical wall and an internal arcuate rib therein. The C-clamp has a threaded spindle extending through the housing, and a nut member in the housing is provided with a threadless bore through which the spindle extends for rapid advancement. The nut member also has a partially offset and partially threaded bore which is selectively engageable with the threaded spindle for threaded advancement of the spindle. The external surface of the nut is comprised of two semi-cylindrical portions overlapping so as to provide definite lines of demarcation between the portions. A friction member in the nut is resiliently pressed against the threads of the spindle to cause the nut to turn with the spindle in either direction. The nut cooperates with the arcuate rib, and depending on the direction of turning shifts the nut to cause the non-threaded bore to cooperate with the spindle for rapid advancement of the spindle, or to cause the partially threaded bore to cooperate with the threads of the spindle for threaded advancement of the spindle. The nut comprises a steel investment casting, while the frame of the C-clamp is forged steel, and the threaded spindle is copper coated for lubrication without the necessity of petroleum base lubricants.

8 Claims, 6 Drawing Figures

FIG. 1
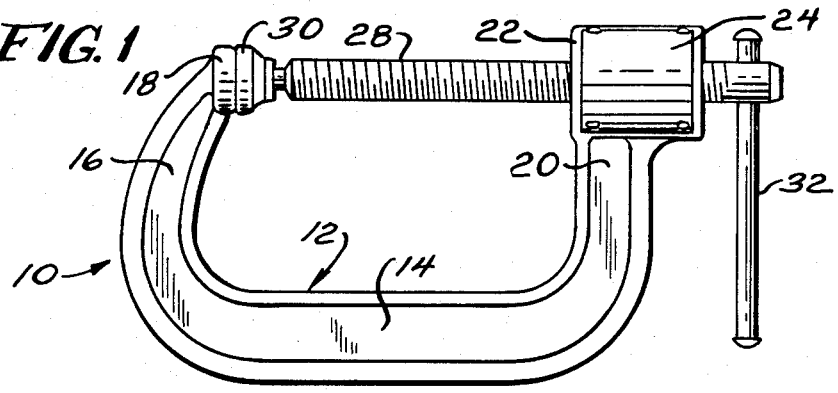
FIG. 2
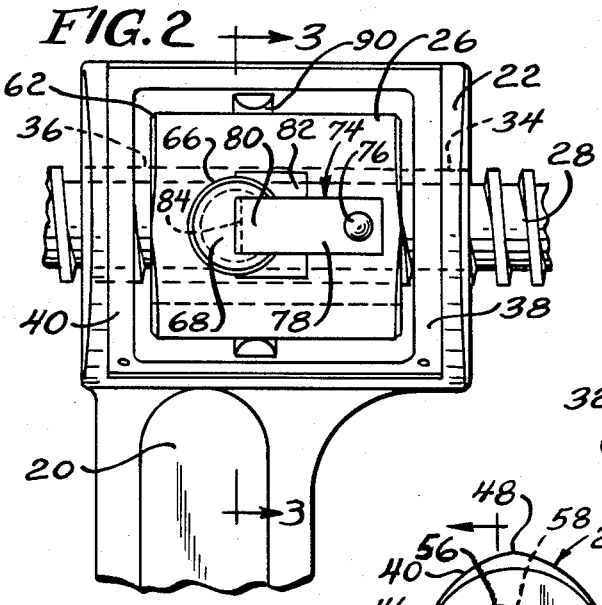
FIG. 3
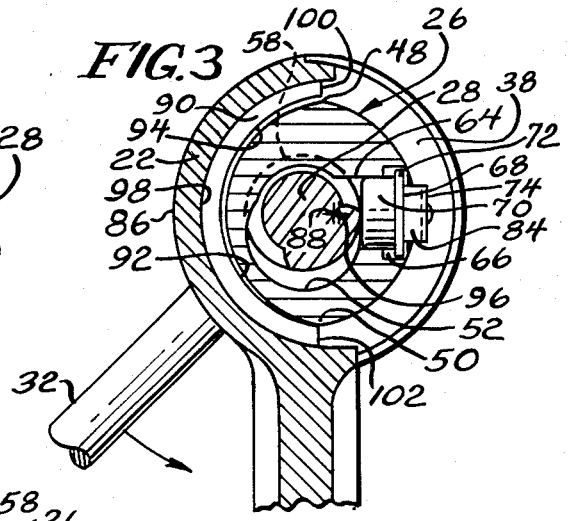
FIG. 5
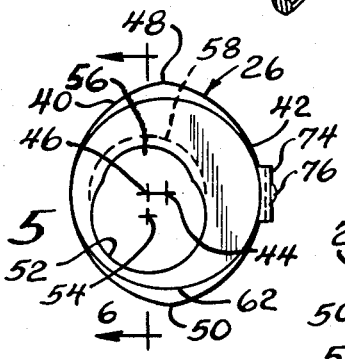
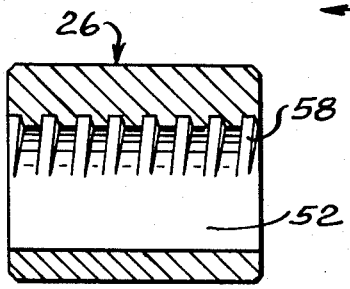
FIG. 6
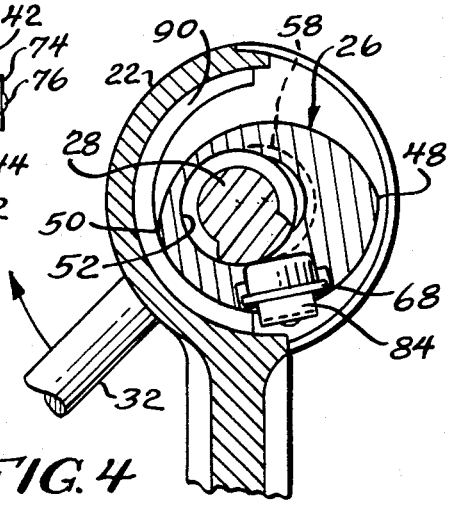
FIG. 4

RAPID ACTING C-CLAMP

BACKGROUND OF THE INVENTION

In C-clamps, vises, and other clamping devices, a screw threaded shank moves a clamping device such as a pressure pad, a vise jaw, etc. Turning of the threaded shank advances the clamping device thread-by-thread. However, in large C-clamps, large vises, or any clamping device having a large throat it is desirable to move the threaded shank axially over a substantial distance rapidly without having to turn the shank and advance it thread-by-thread.

Devices for attaining this end are known in which a nut or other structure in which the shank turns has only partial threads which the shank may engage for advancing thread-by-thread, or from which the threaded shank may be disengaged for axial movement of the shank rapidly without regard for the threads. One such device is shown in Farrell U.S. Pat. No. 2,430,458. Various problems were found in practice with the device disclosed in the aforesaid Farrell patent. Both the C-shaped frame and the partially threaded nut were made of cast iron. It was found in practice that the cast iron would sometimes fail, either through fracture of the C-shaped frame, or through sudden stripping of the partial threads from the nut. This resulted in considerable danger to workers in the area as well as to the immediate user, since large clamps are frequently used for hoisting and conveying rather heavy articles. Failure of either the C-shaped frame or the nut resulted in dropping a part so carried with considerable danger to those in the area.

Furthermore, the cross-sectional shape of the nut was generally oval, consisting of arcs of different radii blending smoothly into one another. The shape of the housing for the nut was semi-cylindrical, with parallel walls extending from the semi-cylinder. As a result, there were large areas in contact which presented frictional or rubbing problems which could result in erratic and unpredictable operation, or jamming of the nut within the housing. Although friction is theoretically independent of area, in actual practice the surfaces of cast members tend to be rather rough, whereby there is a resistance to moving of one surface over the other which is considerably in excess of the actual frictional resistance. Minor protuberances and declevities of confronting surfaces often tend to lock with one another to present a rather substantial resistance to relative movement.

OBJECTS AND SUMMARY OF THE PRESENT INVENTION

It is an object of the present invention to provide a rapid acting C-clamp somewhat similar to that disclosed in Farrell U.S. Pat. No. 2,430,458, but made of carefully selected materials overcoming many of the disadvantages of the aforesaid Farrell device.

It is further an object of the present invention to provide a rapid acting C-clamp having a partially threaded nut the exterior surface of which is formed by two overlapping circles of equal diameter presenting rather definite lines of demarcation facilitating engagement and disengagement of the threads.

It is a further object of the present invention to provide a rapid acting C-clamp of the type previously referred to in which the housing for the nut has an internal annular rib engageable with the nut over a limited area and affording an improved action therewith.

Although the principles of the present invention are applicable to vises and other clamping devices, the specific disclosure is of a large, rapid acting C-clamp in which the C-shaped frame comprises a steel forging. A partially threaded nut member comprises a steel investment casting utilizing a lost wax process. The threaded shank and certain coacting parts are copper plated to reduce friction without the necessity of a messy, petroleum based lubricant. The partially threaded nut is formed in cross-section of two circles of equal radius, but overlapping so as to present definite lines of demarcation at 180 degree locations. In cooperation with this shape, the housing for the nut is provided with an internal semi-circular rib engageable with the nut over a limited area.

BRIEF DESCRIPTION OF THE DRAWINGS

The invention will best be understood from the ensuing description when taken in connection with the accompanying drawings wherein:

FIG. 1 is a plan view of a C-clamp constructed in accordance with the principles of the present invention;

FIG. 2 is an enlarged fragmentary view with the cover removed from the housing for the partially threaded nut, and showing the nut;

FIG. 3 is a cross-sectional view taken substantially along the line 3—3 in FIG. 2;

FIG. 4 is a view similar to FIG. 3 showing the parts in a different position of operation;

FIG. 5 is an end view of the nut; and

FIG. 6 is an axial sectional view through the nut taken substantially along the line 6—6 in FIG. 5.

DETAILED DESCRIPTION OF THE ILLUSTRATED EMBODIMENT

Turning now to the drawings in greater particularlity, there is shown a C-clamp 10 having a C-shaped frame 12 comprising a substantially straight bar 14 having a substantially flat central web and transverse edge flanges thereon. The frame comprises a steel forging. The frame further includes a remote arm 16 curving and extending generally transversely of the bar 14 to an anvil portion 18. The frame further includes a right angle arm 20 joining over a short curve to the bar 14, and carrying at its upper end (as viewed in FIG. 1) a housing 22 having a generally semi-cylindrical sheet metal cover 24 thereover, and housing a nut 26.

An elongated threaded shaft or spindle 28 extends through the housing and the nut and is provided at the far end with a swiveling pad 30 in opposition to the anvil 18. A cross-handle 32 is slideably mounted in a transverse bore through the near end of the shaft or spindle 28. The shaft or spindle 28, the pad 30, and the cross-handle 32 are copper coated by an electro-plating process, these parts being made of steel, whereby greatly to reduce friction between the shaft or spindle and the nut, and also between the spindle and the pad 30 and the cross-handle 32 without requiring a messy, petroleum based lubricant. The threaded spindle 28 passes through non-threaded cylindrical bores 34 and 36 through the end walls 38 and 40 of the housing 22.

The nut 26 is axially elongated, and in cross section or end view, as seen in FIGS. 3–5, is comprised of two semi-circles (or semi-cylindrical surfaces) 40 and 42. The center of each semi-circle or semi-cylinder is disposed within the other semi-circle or semi-cylinder, the center for the semi-circle 40 being indicated at 44 in FIG. 5, and the center for the semi-circle 42 being indicated at 46. The result is that the semi-cylindrical surfaces overlap to the point where they join at apexes 48 and 50, comprising definite lines of demarcation.

The nut 26 is provided with an off center cylindrical bore 52 cylindrical about a center 54, lying rather close to the outside wall of the nut in the lower left quadrant thereof as viewed in FIG. 5. The nut further is provided with a partially offset cylindrical bore 56 having a center substantially coincident with the center 46 and provided with partial threads 58 of proper dimensions to mesh with the threads of the spindle 28. The spindle is capable of mating with the threads 58, or of passing through the cylindrical bore 52 free of engagement with the threads 58, as will be brought out in greater detail hereinafter. Both ends of the nut are somewhat tapered adjacent the apices thereof, whereby in end view the nut has a circular end 62 as seen in FIG. 2.

The nut is provided with a cross bore 64 which is substantially diametral relative to the threaded bore 58 and which has a counter bore 66. A steel friction shoe 68 has a cylindrical body portion 70 received in the bore 68 and a radial flange or enlarged head 72 received within the counter bore 66. As may be seen in FIG. 2 the friction shoe 68 and the bore and counter bore are relatively adjacent one end of the nut.

A leaf spring 74 is secured relatively adjacent the opposite end of the nut by a pin or rivet 76 passing through a flat body portion 78 of the spring. An end portion 80 of the spring angles inwardly of the nut at a shallow angle, the adjacent surface of the nut being machined flat at 82 for clearance. The extremity of the spring is turned inwardly at substantially right angles a flange 84 substantially perpendicular to the axis of the nut and bearing against the outer end of the friction shoe 68. The inner end of the shoe 68 bears against the crests of the threads of the spindle 28 and tends to hold the spindle either in the non-threaded bore 52 or in the threaded bore 58, which ever it is in.

The outer surface 86 of the housing 22 is substantially a semi-cylinder. Specifically, it has a radius of 1-1/16 inch taken about a center 88 indicated in FIG. 3. The inner surface is also substantially a semi-circle, having specifically a radius of $\frac{7}{8}$ inch about the same center. Approximately one half inch from the left end wall 40 as viewed in FIG. 2, there is provided a rib 90. The rib superficially is semi-circular, but there is an important departure from a semi-circle. The bottom half of the rib 92 (as viewed in FIGS. 3 and 4) has a radius of 47/64 inch taken about the same center 88 as identified previously. However, the upper portion or half of the rib has an inner diameter 94 of 49/64 inch taken about a center 96 displaced 1/32 of an inch to the right of the center 88. Thus, there is no break between the slightly different arcuate inner surfaces of the rib. The inner surface of the side wall 98 has a radius of $\frac{7}{8}$ inch about the first-mentioned center 88. The upper end 100 of the rib 90, and the lower end 102 thereof are shown as straight edges, but as a practical matter, are somewhat rounded off at the corners. The cross section of the rib is substantially semicircular as seen in FIG. 2.

In operation of the C-clamp, the nut should be considered as on the spindle in such fashion that the partial threads 58 of the nut are in full engagement with the threads of the spindle. This is shown in FIG. 3. Turning of the handle 22 in a clockwise direction as viewed in FIGS. 3 and 4 brings the lower apex 50 of the nut into engagement with the inner surface of the rib 90 as shown in FIG. 3. Continued clockwise rotation causes the apex 50 and the joining nut surface in a counter-clockwise direction to ride along the rib inner surface 92 progressively shifting the nut laterally (upwardly and to the right in FIG. 4) until the end 50 of the rib engages the nut substantially at the counter bore 66, whereupon the nut has been shifted laterally substantially to move the nut threads 58 away from the threads of the spindle 28. The spindle then is in the non-threaded bore 52, whereby the spindle can be moved axially in or out of the nut without turning of the spindle. This allows rapid adjustment of the spindle and the position of the clamping pad 30.

When it is desired to adjust the spindle more precisely by means of the threads thereon, and more particularly to effect a clamping action with the pad 30 toward the anvil 18, the handle 32 is turned in a counter-clockwise direction as viewed in FIGS. 3 and 4. This turns the nut to a substantially upright position, causing the upper left portion (clockwise from the apex 48) to engage the inner surface 94 of the rib 90 adjacent the end 100 thereof and progressively to shift the nut, mostly vertically in FIG. 3, to bring the partial threads of the nut into engagement with the threads of the spindle. The spindle thus can be advanced turn-by-turn through the nut and the pad 30 can be brought into clamping engagement with a workpiece opposite to the anvil 18.

The important features of the invention to be noted are the exterior shape of the nut, the provision and shape of the rib 90, the shape of the spring 74 with the free end thereof abutting the friction shoe 68, the copper plating of the spindle 28, of the handle, and of the pad, the forging of the frame of the C-clamp, and the investment casting of the nut.

It will be understood that the friction pad 68 bears against the threads of the spindle 28 and causes the nut to turn frictionally with the spindle until the nut is limited by engagement with the rib 90 as previously discussed.

The specific example of the invention as herein shown and described is for illustrative purposes only. Various changes in structure may occur to those skilled in the art and will be understood as forming a part of the present invention insofar as they fall within the spirit and scope of the appended claims.

The invention is claimed as follows:

1. A rapid advance screw thread construction comprising a housing having a side wall which is at least in part substantially semi-cylindrical and further having spaced end walls, said housing having an internal arcuate rib in said substantially semi-cylindrical portion, said end walls having aligned cylindrical openings therethrough, a screw threaded spindle passing through said openings and said housing and rotatably and axially movable in said openings, a nut member in said housing having a smooth bore therein through which said spindle passes for free axial movement, said nut member having an offset overlapping partially threaded bore for selective threaded cooperation with the threads on the spindle for threaded movement of said spindle through said nut member, and yieldable means in said nut member pressing transversely on the threads of said spindle for frictionally tending to turn said nut member with said spindle, said nut member being so dimensioned and proportioned relative to said housing rib that it engages one portion or another of said rib depending on the direction of turning of said spindle to cause engagement or disengagement of the partial threads in said nut member with the threads of said spindle for threaded or free axial movement of said spindle through said nut member, said rib being substantially semi-circular and having portions thereof of at least two different radii.

2. The construction as set forth in claim 1 wherein said spindle is made of steel and is copper coated.

3. The construction as set forth in claim 1 wherein said housing is a part of a C-clamp having a frame which is a steel forging.

4. A rapid advance screw thread construction as set forth in claim 1 wherein said nut comprises two overlapping semi-cylindrical portions presenting definite lines of demarcation where said portions meet.

5. A rapid advance screw thread construction comprising a housing having a side wall which is at least in part substantially semi-cylindrical and further having spaced end walls, said housing having an internal arcuate rib in said substantially semi-cylindrical portion, said rib in cross section tapering from a relatively wide base joined to said housing to a relatively narrow free outer portion, said end walls having aligned cylindrical openings therethrough, a screw threaded spindle passing through said openings and said housing and rotatably and axially movable in said openings, a nut member in said housing having an offset overlapping partially threaded bore for selective threaded cooperation with the threads on the spindle for threaded movement of said spindle through said nut member, and yieldable means in said nut member pressing transversely on the threads of said spindle for frictionally tending to turn said nut member with said spindle, said nut member being so dimensioned and proportioned relative to said housing rib that it engages one portion or another of the free outer portion of said rib depending on the direction of the turning of said spindle to cause engagement or disengagement of the partial threads in said nut member with the threads of said spindle for threaded or free axial movement of said spindle through said nut member.

6. A rapid advance screw thread construction as set forth in claim 5 wherein said rib in cross section is substantially semi-circular.

7. A rapid advance a screw thread construction comprising a housing having spaced end walls, said end walls having aligned cylindrical openings therethrough, a screw threaded spindle passing through said openings and said housing and rotatably and axially movable in said openings, a nut member in said housing having a smooth bore therein through which said spindle passes for free axial movement, said nut member having an offset overlapping partially threaded bore for selective threaded cooperation with the threads on said spindle for threaded movement of said spindle through said nut member, and yieldable means in said nut member pressing transversely on the threads of said spindle for frictionally tending to turn said nut member, said nut member comprising two semi-cylindrical portions overlapping one another and joining at non-offset definite lines of demarcation and being so proportioned relative to said housing that said nut member engages on one side or the other of said housing depending on the direction of turning of said spindle to cause engagement or disengagement of the partial threads in said nut member with the threads of said spindle for threaded or free axial movement of said spindle through said nut member.

8. A rapid advance screw threaded construction as set forth in claim 7 wherein said nut member semi-cylindrical portions are of the same radius.

* * * * *